United States Patent [19]

Forsman

[11] Patent Number: 4,682,952

[45] Date of Patent: Jul. 28, 1987

[54] TRAINING DEVICE

[75] Inventor: Allyn J. Forsman, Eden Prairie, Minn.

[73] Assignee: Honeywell Inc., Minneapolis, Minn.

[21] Appl. No.: 780,776

[22] Filed: Sep. 27, 1985

[51] Int. Cl.[4] ..... G09B 9/00; F41F 27/00

[52] U.S. Cl. ..... 434/12

[58] Field of Search ..... 434/11, 12, 13, 16, 434/19

[56] References Cited

U.S. PATENT DOCUMENTS

| | | | |
|---|---|---|---|
| 2,674,923 | 4/1954 | Brandt | 434/12 |
| 3,112,671 | 12/1963 | Dunham et al. | 434/12 |
| 4,447,211 | 5/1984 | Kern et al. | 434/12 |
| 4,465,464 | 8/1984 | Schoenberg | 434/12 |

*Primary Examiner*—William H. Grieb

*Attorney, Agent, or Firm*—Roger W. Jensen

[57] ABSTRACT

An arrangement for facilitating the training of personnel in the handling of recoilless rifles which includes an accessory for insertion into the rifle launcher for giving it the same weight and center of gravity as a loaded launcher.

5 Claims, 3 Drawing Figures

TRAINING DEVICE

The Government has rights in this invention pursuant to Contract No. DAAH10-84-C-0641 awarded by the Department of the Army.

FIELD OF THE INVENTION

This invention relates to the field of military equipment, and particularly to means for facilitating the training of military personnel in the use of recoilless rifles.

BACKGROUND OF THE INVENTION

A recoilless rifle is a shoulder-fired weapon and comprises a tubular launcher containing a single projectile for use against armored vehicles such as tanks. A typical unit is over 3 feet long, has a 3-inch bore, and weighs about 15 pounds. It is hazardous both forwardly and rearwardly on firing. Such a weapon is awkward to handle and personnel to be armed with these rifles must be trained to handle them safely and effectively. It is not desirable for personnel under training to be equiped with "live"ammunition, that is, with a launcher containing an actual live projectile. An empty launcher's weight, center of gravity, and handling characteristics are so different from those of a loaded one that training with empty launcher is ineffective.

SUMMARY OF THE INVENTION

The present invention comprises an accessory insertable and securable in an empty launcher which gives the assembly the same weight, center of gravity, and handling characteristics as a loaded weapon, to enable effective training to be conducted without the hazardous presence of live weapons.

Various advantages and features of novelty which characterize the invention are pointed out with particularity in the claims annexed hereto and forming a part hereof. However, for a better understanding of the invention, its advantages, and objectives attained by its use, reference should be made to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals refer to corresponding parts throughout the several views.

DESCRIPTION OF THE PREFERRED EMBODIMENT

Figure 1:
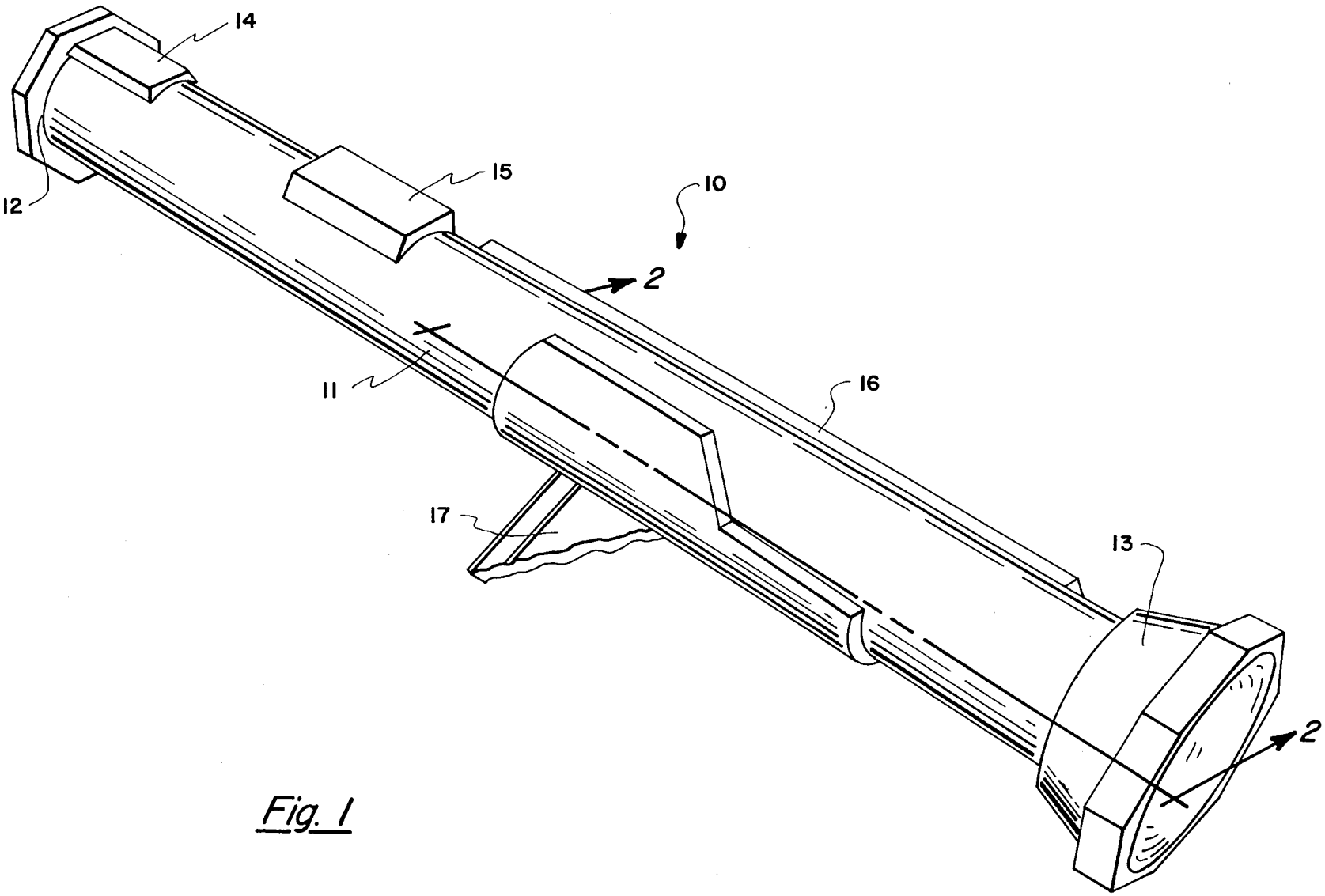
FIG. 1 is a somewhat schematic showing of a launcher which uses the invention.
Figure 3:
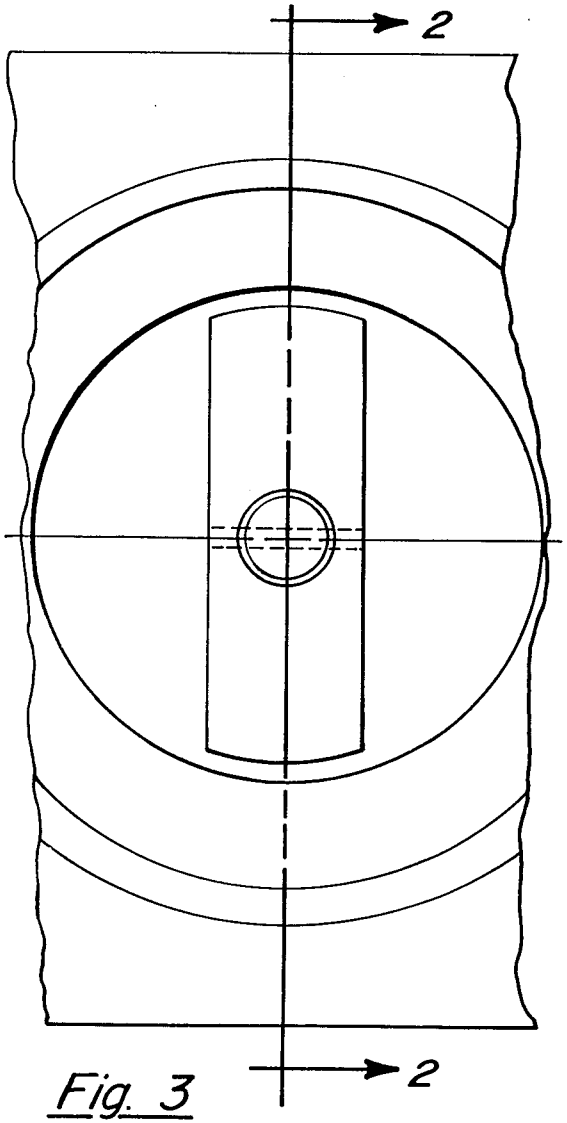
FIG. 3 is an end view.

As shown in FIG. 1, recoilless rifle 10 comprises a tubular barrel 11 extending from a muzzle 12 at one end to a venturi 13 at the other end. Removable sight covers 14 and 15 protect front and rear sights, and the firing mechanism, including cocking and safety elements, is suggested at 16. A folding shoulder stop is shown at 17, and a carrying sling, not shown, is usually provided.

Figure 2:
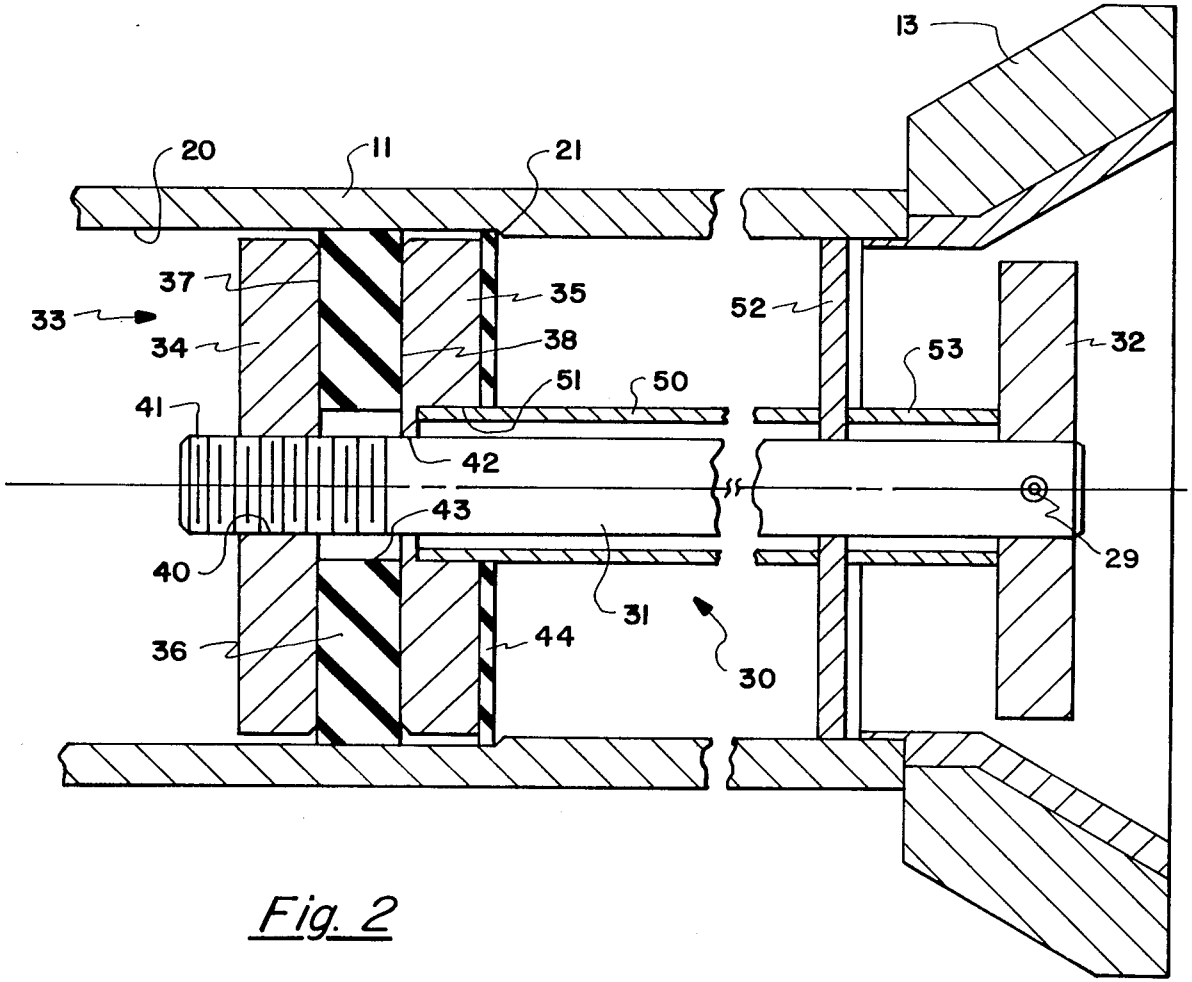
FIG. 2 is an axial section generally along the line 2—2 of FIG. 1, showing the accessary in place.

The launcher is to be loaded from the muzzle end, and as shown in FIG. 2, barrel 11 has a bore 20 with an internal step 21 for positioning the projectile on insertion. Upon firing, the projectile exits at the muzzle, and the launch gases exit at the venturi.

The accessory according to the invention is shown at 30 in FIG. 2 to comprise a shaft 31 coaxial with the launcher and having a T-handle 32 secured at one end by a pin 29. The length of handle 32 is less than the inner diameter of bore 20 and venturi 13. At its other end, shaft 30 is connected to a mass assembly 33 comprising first and second discs 34 and 35 of heavy, rigid material such as metal, between which is a disc 36 of expandable material such as high density foam rubber: disc 36 is bonded to discs 34 and 35 at 37 and 38. Disc 34 is axially bored and threaded at 40 to receive threads 41 on the end of shaft 30, which turns freely in bores 42 and 43 in discs 35 and 36. The free face of disc 35 has a rubber coating 44. Discs 34 and 35 are of such diameter as to pass easily through bore 20, but disc 36 is a friction fit in the bore.

A tube 50 is secured in a bore 51 in disc 35, and extends to a further disc 52 in which shaft 31 is rotatable. Disc 52 is a loose fit in bore 20. A further tube 53 extends from disc 52 to handle 32. The arrangement is such that when shaft 31 is rotated by handle 32, disc 34 is drawn by the action of threads 41 against disc 35, squeezing disc 36 and causing it to expand radially into gripping engagement with bore 20, which maintains the entire accessory in position. In that position the accessory has such a weight and weight distribution as to give the combination with launcher 10 the same weight and center of gravity as a weapon with a live projectile.

OPERATION

In use, the accessory is dropped into the muzzle of the launcher, T-handle 32 first, disc 36 being unexpanded to slide down the bore, and disc 52 guiding the accessory so that handle 32 passes into venturi 13. The position of the accessory in the bore is set when coating 44 of disc 35 engages step 21. The assembly is now turned horizontal and handle 32, now accessible through venturi 13, is rotated to turn shaft 31. The fit of disc 36 in the bore has sufficient friction to oppose rotation of assembly 33, so that rotation of shaft 30 draws disc 34 toward disc 35, compressing disc 36 outwardly into tightly gripping engagement with bore 21. The combination of accessory and launcher is now unitary and has the same handling characteristics as a loaded weapon, and the combination can be used safely in drills for training personnel in carrying and manipulating the weapon.

From the above it will be evident that the invention comprises training apparatus including a launcher and an accessory for giving the launcher the same handling characteristics as those of a launcher loaded with a projectile.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. A launcher having a bore to receive a predetermined projectile at a predetermined site therein, to exhibit as a loaded weapon a predetermined weight and center of gravity; and an accessory securable in said launcher in place of said projectile to give the launcher the same weight and center of gravity as one loaded with a projectile, in which said accessory comprises means expandable to grip the inner wall of said launcher for securement therein.

2. The combination of claim 1 in which the expandable means is contained between two massive discs of rigid material, together with means for causing said discs to move together to cause outward expansion of the expandable disc.

3. The combination of claim 2 including means comprising a T-handle accessible through said launcher.

4. In combination:

a launcher comprising a bore extending from a muzzle opening to a rearward opening for receiving a predetermined self-propelled projectile at a site therein predetermined by a step in said bore, to exhibit as a loaded weapon a predetermined weight and center of gravity;

and an accessory insertable into said bore from said muzzle opening in place of sid projectile to give the launcher the same weight and center of gravity as one loaded with a projectile, said accessory including means accessible through said rearward opening for securing said accessory at a predetermined site in said bore, in which the last named means includes a T handle and means acuatable by said handle to expand into gripping contact with said bore.

5. The combination of claim 4 in which the actuable means comprises a disc of expandable material between two massive discs of rigid material and in which said T-handle operates to cause said massive discs to approach one another and compress said expandable material to cause radially outward expansion thereof.

* * * * *